United States Patent [19]

Bilyeu

[11] Patent Number: 4,647,045

[45] Date of Patent: Mar. 3, 1987

[54] PUTTER GUIDE

[76] Inventor: Roy M. Bilyeu, P.O. Box 363, Mason City, Iowa 50401

[21] Appl. No.: 740,533

[22] Filed: Jun. 3, 1985

[51] Int. Cl.[4] ..... A63B 69/36

[52] U.S. Cl. ..... 273/163 A; 273/194 R

[58] Field of Search ..... 273/163 R, 163 A, 164, 273/194 R, 186 A, 183 D

[56] References Cited

U.S. PATENT DOCUMENTS

| | | | |
|---|---|---|---|
| 697,542 | 4/1902 | Robertson | 273/163 R |
| 2,822,614 | 2/1958 | Susinno | 273/163 A |
| 3,033,574 | 5/1962 | Partridge | 273/163 A |
| 3,198,525 | 8/1965 | Smith | 273/163 A |
| 3,273,892 | 9/1966 | Nolting | 273/163 A |
| 3,273,893 | 9/1966 | Duncan | 273/163 A |
| 3,495,834 | 2/1970 | Tanczos | 273/163 A |
| 3,848,873 | 11/1974 | Linning | 273/194 R |
| 4,210,334 | 7/1980 | Lind | 273/162 R |

FOREIGN PATENT DOCUMENTS

| | | | |
|---|---|---|---|
| 328823 | 5/1930 | United Kingdom | 273/163 R |

*Primary Examiner*—George J. Marlo

*Attorney, Agent, or Firm*—Lawrence J. Shurupoff

[57] ABSTRACT

A putter guide assembly for use with a golf club includes a substantially U-shaped bracket for attaching the guide assembly to the club. The bracket has an upper surface portion serving as a support surface and has opposed free side walls each formed with a mounting hole. A pointing member has a lower surface portion which in use abuts and registers with the upper surface portion of the bracket so as to align the pointing member during use. The pointing member is formed with a tubular ringed end portion disposed between the sidewalls for pivotal attachment to the bracket. A bolt passes through each one of the mounting holes and through the tubular ringed end portion so as to rotatably connect the pointing member to the bracket. The bolt serves as a pivot for the pointing member and further serves as a fastener for securing the guide assembly to the club.

3 Claims, 12 Drawing Figures

PUTTER GUIDE

BACKGROUND OF THE INVENTION

1. Field of the Invention

This invention relates generally to golf club aligning devices and more particularly to a detachable putter guide having a brightly colored pointer or indicator for increasing the visibility of the pointer by color contrast against the surface of the putting green.

2. Description of Prior Developments

Golf club aiming devices are well known as evidenced by U.S. Pat. Nos. 697,542, 2,822,614, 3,033,574, 3,198,525, 3,273,892, 3,273,893 and 3,495,834. Each of these patents is generally concerned with aligning the face of a golf club at a right angle with a straight line running between the cup or hole and the center of the golf ball. While many different structures are described in these patents for attaching the various alignment devices to the club faces or club shafts and for providing an indicator or guide for alignment purposes, no teaching can be found concerning the visibility of the pointer against the green background of the putting green.

Most conventional putter guides are provided with pointers formed from sheet metal. No particular attention has been given to the specific color of the pointers and any concern of the visibility of the pointer during use has generally been disregarded. Accordingly, it is not uncommon when using a conventional putter guide to lose sight of the pointer while aligning the club face against the golf ball. Since a golfer's eyes have difficulty in simultaneously focusing on the ball, the club face, and the pointer of the putter guide while concurrently trying to view the cup, many golfers unintentionally tend to ignore the presence of the pointer since it often tends to fade or blend into the background of the putting surface. This condition significantly decreases the effectiveness of most putter guides. Accordingly, a need exists for a putter guide which will provide a distinct, bright and sharp visual image of the pointer against the putting surface so that the directional guidance provided by the pointer is fully available to and utilized by the golfer.

SUMMARY OF THE INVENTION

The present invention has been developed to overcome the drawbacks noted above and therefore has as a primary object the provision of a golf club alignment device having a pointer colored so as to sharply contrast the outline of the pointer against the background of the putting surface.

Another object is to provide a detachable putter guide which is extremely simple and economical to manufacture and has a miniumum number of parts.

Still another object is to provide a detachable putter guide which may be folded against the shaft of the club to which it is attached in order to facilitate storage.

The realization of these and various other objects, features and attendant advantages of the present invention will be more fully appreciated from the following description when considered in connection with the accompanying drawings, in which the same reference numbers designate the same or corresponding parts throughout.

DETAILED DESCRIPTION OF THE PREFERRED EMBODIMENT

The putter guide developed in accordance with the present invention will now be described in conjunction with accompanying FIG. 1 within which for example, it is seen that the construction of the putter guide is extremely simple and requires a minimum number of parts. This simple construction allows for easy assembly and packaging and results in a most economical product.

Figure 2:
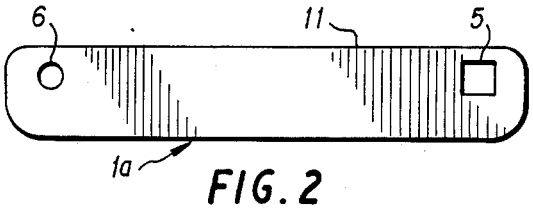
FIG. 2, which is a side elevation view of a metal blank used to form the mounting bracket for the putter guide.
Figure 3:
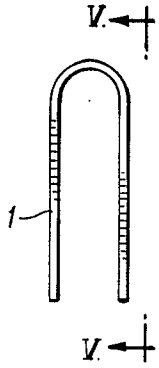
FIG. 3, which is a top plan view of the mounting bracket after it has been formed.
Figure 4:
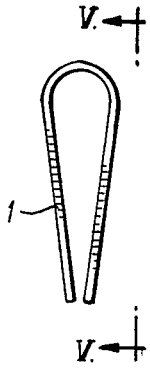
FIG. 4, which is a top plan view of an alternate embodiment of the mounting bracket.
Figure 5:
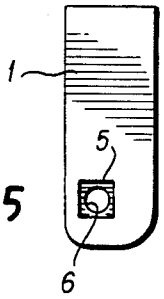
FIG. 5, which is a side elevation view of the mounting bracket taken along lines V—V of FIGS. 3 and 4.

The basic construction of the putter guide requires only four parts; a bracket (1), a pointer (2) a bolt (3) and a nut (4). The bracket is typically formed from sheet metal and may be blanked out from flat stock material to form blank (1*a*) as shown in FIG. 2, then bent in either a U shape having parallel side walls as shown in FIG. 3 or a horseshoe shape having side walls which converge toward each other at their free ends, as shown in FIG. 4. FIG. 5 shows a side view of the brackets of both FIGS. 3 and 4. A suitable stock material is 0.07 inch thick stainless steel sheet stock. Stainless steel is preferred for rust resistance as well as appearance.

Figure 1:
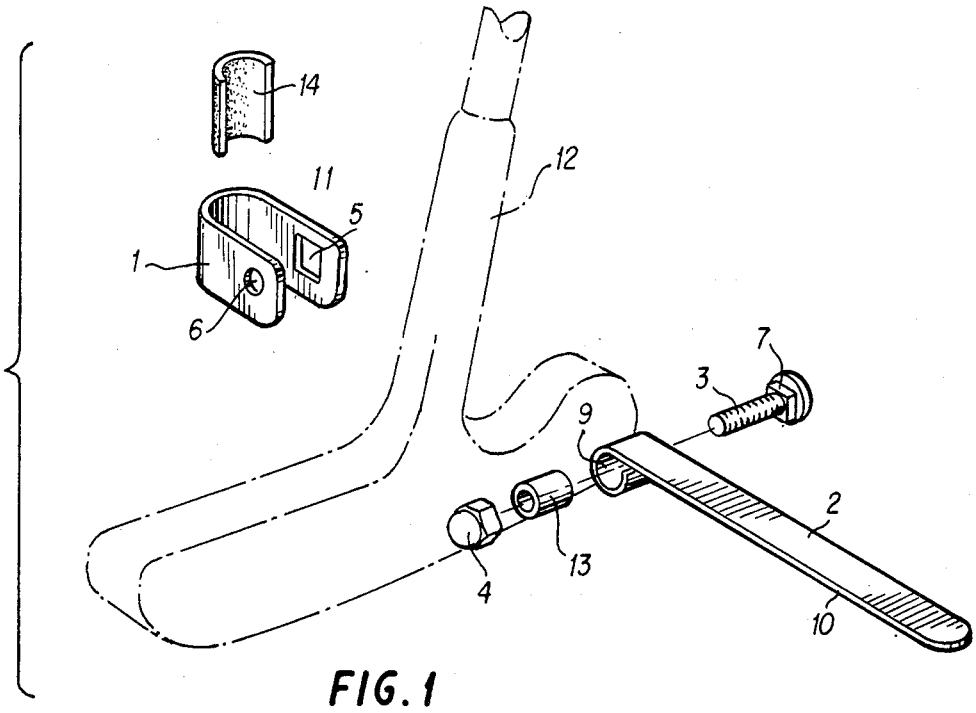
FIG. 1, which is a schematic, exploded, perspective view of the putter guide showing a putter club in phantom.
Figure 8:
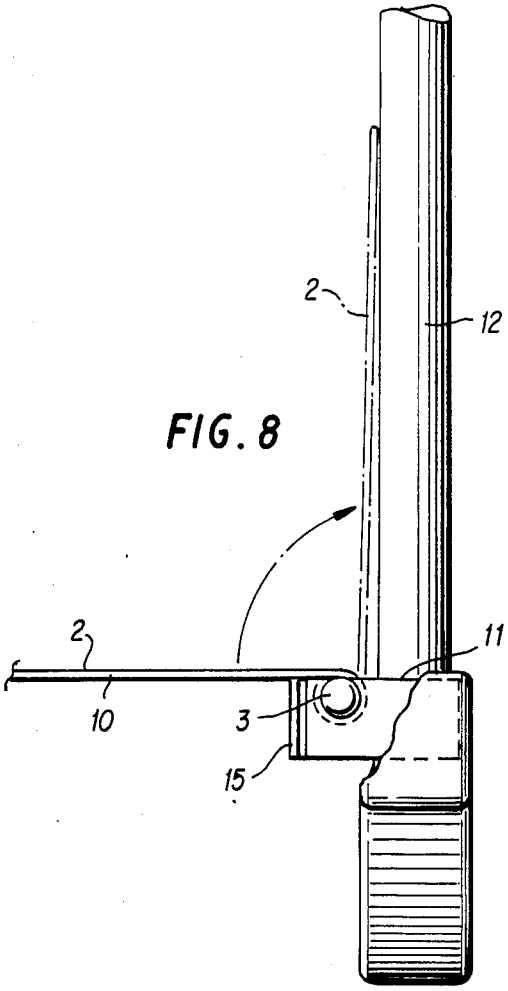
FIG. 8, which is a side elevation view of the putter guide disposed in an operative position on a golf club and showing an alternate storage position in phantom.
Figure 10:
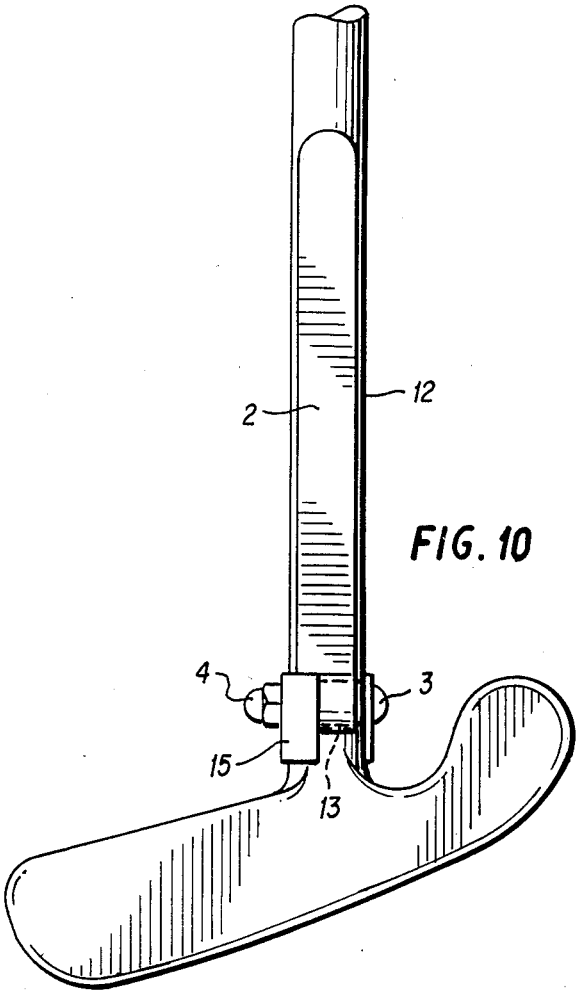
FIG. 10, which is a front elevation view of the putter guide showing the pointer in a storage position.
Figure 12:
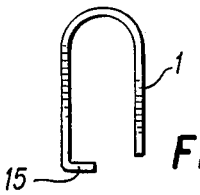
FIG. 12, which is a top plan view of an alternate embodiment of the bracket.

As further shown in FIGS. 1 and 2, the bracket is formed with a square hole (5) at one end and with a round hole (6) at the opposite end. This allows the use of carriage bolt (3) which is anchored by its square shoulder (7) within hole (5) thereby obviating the use of lock washers to prevent rotation of the bolt. The holes (5) and (6) formed in the bracket are located such that the lower surface (10) of the pointer will register with the upper surface (11) of the bracket in a parallel relationship as shown in FIG. 8. This ensures a substantially horizontal alignment of the pointer during use so that the pointer will be substantially parallel with the putting surface when used. FIG. 8 also depicts the alternate storage position of the pointer in phantom, after rotation about the bolt. FIG. 10 shows another view of the pointer in its storage position against the club shaft.

Figure 6:
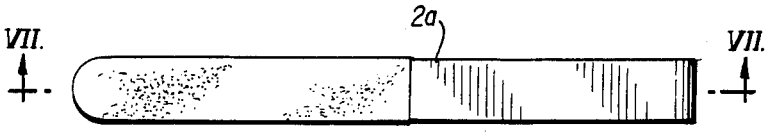
FIG. 6, which is a top plan view of the pointer in blank form.
Figure 7:
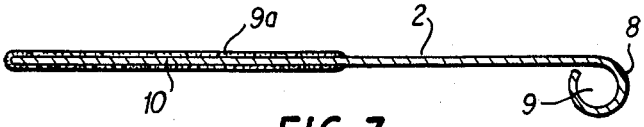
FIG. 7, which is a sectional side elevation view of the pointer in finished form taken along line VII—VII of FIG. 6 showing a painted coating applied to the pointer.

The pointer (2) may also be blanked from a stock material such as 0.06 inch flat stainless steel sheet stock as shown in FIG. 6. The pointer blank (2*a*) shown in FIG. 6 is then formed as shown in FIG. 7 with a tubular ringed end portion (8) defining a channel (9) through which the carriage bolt is fastened. A bright colored surface coating (9*a*) is also shown in FIG. 7 and will be further discussed below.

An acorn nut (4) may be used to fasten the bracket to the club shaft (12) while simultaneously locking the pointer to the bracket. While not absolutely necessary, a bushing (13) may be fitted within channel 9 of the pointer to provide additional stability to the assembled guide structure. The bushing may be cut from a brass tube. Another optional component is semi-annular shim (14) which may be formed of a soft resilient material such as rubber or fiber. The soft shim is inserted between the bracket and the club shaft to prevent scratching and marring of the shaft as well as to firmly and resiliently anchor the bracket to the club shaft in the manner of a lock washer. This prevents horizontal rotation of the bracket around the club shaft and locks the bracket in place. In addition, since the diameters of club shafts vary, a plurality of shims of varying thicknesses may be provided with the putter guide to adapt the bracket to various clubs.

Figure 9:
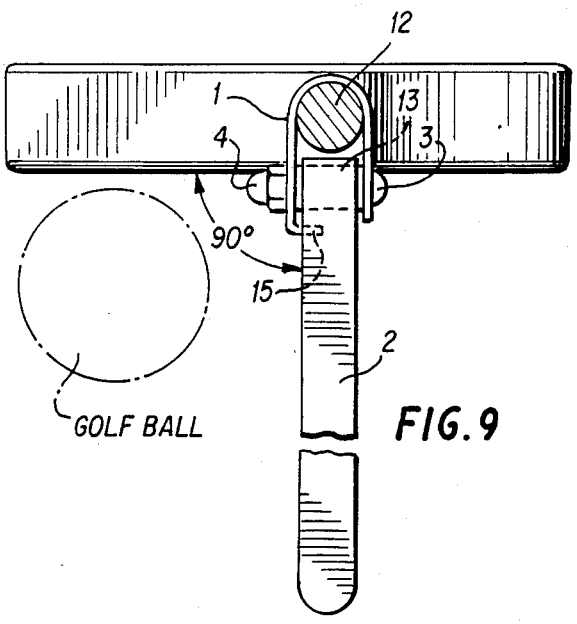
FIG. 9, which is a top plan view of the putter guide in an operative position.

The bracket should be mounted to the club shaft such that the pointer, when positioned for putting, will be aligned substantially perpendicular to the face of the club, as shown in FIG. 9. The relative position of a golf ball is also shown in FIG. 9 wherein the ball is located between the face of the club and the pointer.

Figure 11:
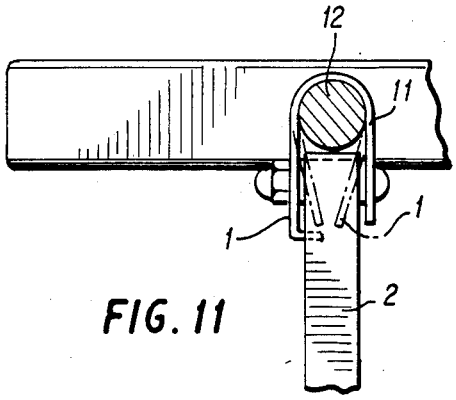
FIG. 11, which is a schematic top plan view of an alternate embodiment of the putter guide having a modified bracket and which excludes the bolt and nut for clarity of illustration.

The guide assembly shown in FIG. 1 is preferably clamped to the club shaft such that the sidewalls of the bracket are bent inwardly toward each other so that the bracket resiliently takes the form shown in phantom in FIG. 11. In this compressed form, the bracket provides a support for the pointer along surface (11) as shown in FIG. 11. Of course, the bracket may be plastically deformed as depicted in FIG. 4, then snapped over the club shaft and secured thereto with the carriage bolt. Another embodiment of the bracket is also shown in FIG. 11 and will be discussed immediately below.

Instead of plastically or elastically deforming the bracket to provide a support surface for the pointer as shown in phantom FIG. 11, an elbow bend portion (15) may be formed on one or both free ends of the bracket, as shown in FIGS. 8 through 12.

A most important concept of this invention lies in the enhanced visibility of the pointer. This visibility is achieved in two ways. The first way is to form the pointer as a relatively wide flat bar having a width ranging from about ¼ inch to ½ inch and preferably ⅜ inch. The pointer may extend about 3 inches outwardly from the face of the club. A pointer of this size provides sufficient surface area to maintain its clear visibility throughout the putting process.

The second way that the visibility of the pointer is enhanced is by providing the pointer with a surface coating (9*a*) such as a paint coating having a bright color which sharply contrasts with the background of the putting surface. A portion or all of the pointer may be dipped or sprayed with a bright glossy paint such as a white enamel paint. Either the tip of the pointer or all of the pointer may be so modified. To even further enhance the visibility of the pointer a phosphorescent or "day-glow" paint may be applied thereto in such colors as white, orange and yellow.

In combination, the wide and long pointer provided with a bright colored surface results in an easily noticed direction indicator which does not easily fade out of the golfer's sight or blend into the background of the putting surface. The pointer so formed maintains its visibility and forces its presence into the golfer's visual perception throughout the putting process and allows the full benefits of the putting guide to be realized.

Instead of coating the pointer with a bright coating, the pointer may alternatively be formed from a bright material such as brightly dyed plastic material. In this case the pointer may be injection molded in one step, thereby avoiding the extra bending step used to form the channel as required when using metal stock.

Obviously, numerous modifications and variations of the present invention are possible in light of the above teachings. It is therefore to be understood that within the scope of the appended claims, the invention may be practiced otherwise than as specifically described herein.

I claim:

1. A putter guide assembly for use with a golf club, comprising:

a substantially U-shaped bracket for attaching said guide assembly to said club, said bracket having opposed sidewalls of lengths such that an upper surface portion thereof serves as a support surface for a pointing member pivotally attached thereto, each one of said side walls being formed with a mounting hole therethrough;

a pointing member having a lower surface portion which in use, when said pointing member is pivotally attached to said bracket and at least one of said sidewalls is bent toward the other sidewall, abuts and registers with said upper surface portion of said bracket so as to be supported by said bracket during use, said pointing member having a first tubular ringed end portion disposed between said opposed sidewalls for pivotal attachment to said bracket and a second free end portion extending beyond said sidewalls; and a bolt passing through each one of said mounting holes and through said tubular ringed end portion so as to rotatably connect said pointing member to said bracket, said bolt serving as a pivot for said pointing member and further serving as a fastener for securing said guide assembly to said golf club.

2. The assembly of claim 1, further comprising a tubular bushing disposed around said bolt and between said opposed side walls.

3. The guide assembly of claim 2, further comprising a painted surface portion provided on said pointing member for maintaining clear visibility of said pointing member against an adjacent playing surface.

* * * * *